United States Patent [19]

Horiuchi et al.

[11] 3,955,475

[45] May 11, 1976

[54] AXIAL PISTON POWER TRANSMISSION

[75] Inventors: Takeshi Horiuchi, Ibaraki; Kazuaki Ogawa, Settu, both of Japan

[73] Assignee: Daikin Kogyo Co., Ltd., Osaka, Japan

[22] Filed: Oct. 4, 1974

[21] Appl. No.: 512,220

[52] U.S. Cl. ..... 91/499

[51] Int. Cl.[2] ..... F01B 13/04

[58] Field of Search ..... 91/492, 499, 506; 417/222

[56] References Cited

UNITED STATES PATENTS

| | | | |
|---|---|---|---|
| 3,221,660 | 12/1965 | D'Amato | 417/220 |
| 3,631,764 | 1/1972 | Lucien | 417/222 |
| 3,693,508 | 9/1972 | Chondzinski | 91/499 |
| 3,732,041 | 5/1973 | Beal | 417/222 |

*Primary Examiner*—William L. Freeh

*Attorney, Agent, or Firm*—Cushman, Darby & Cushman

[57] ABSTRACT

An axial piston power transmission of which a housing is provided with a protruded portion extending from the inner surface toward the outer periphery of a cylinder barrel and the maximum flow velocity of drain is generated between the protruded portion and the outer periphery of the cylinder barrel so that renewal of drain may be stimulated, simultaneously a cooling effect with respect to all sliding surfaces within the housing may be improved and also the variational characteristc may be held constant by making a thrust plate variable in an angle of inclination thereof.

3 Claims, 6 Drawing Figures

AXIAL PISTON POWER TRANSMISSION

Figure 1:
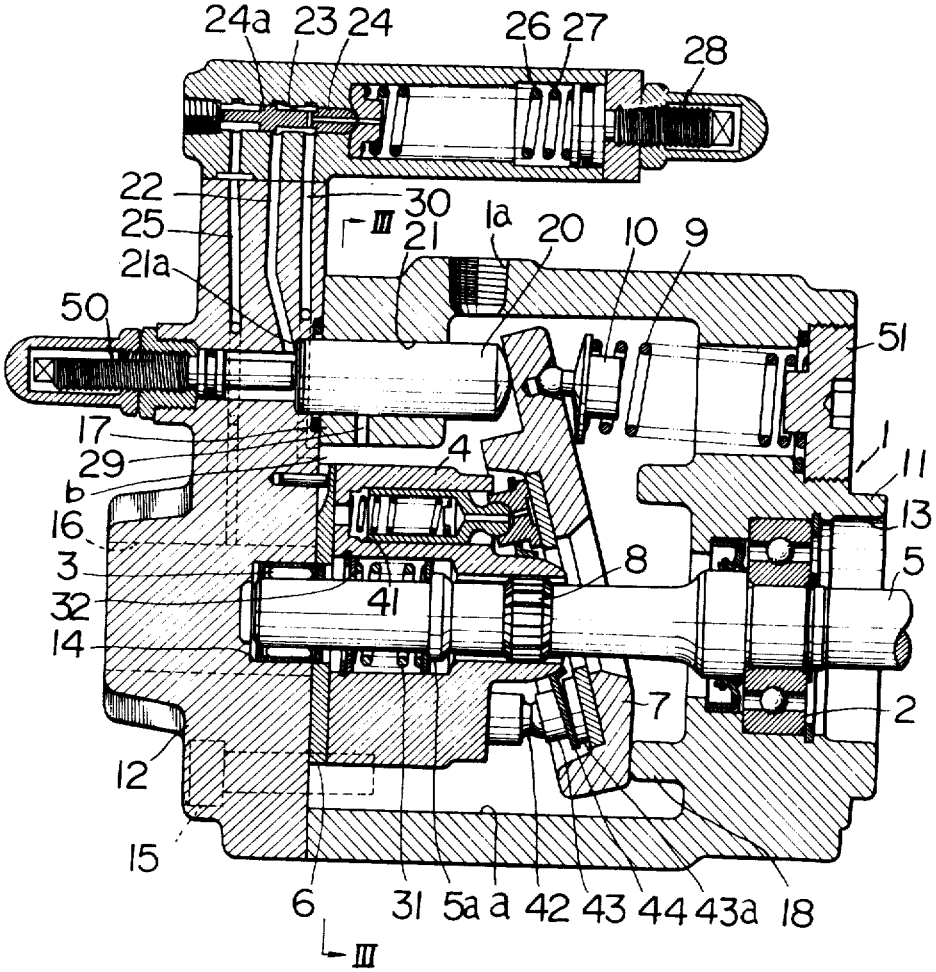

This invention relates to an axial piston system power transmission and more particularly to a hydraulic power transmission serving as an axial piston pump employing a cylinder barrel which is provided with a plurality of pistons and is revolved for discharging fluid by reciprocating motion of the pistons following the revolution thereof, or an axial piston motor employing a cylinder barrel which is revolved by means of reciprocating motion of pistons caused by a high pressure fluid.

Conventionally, this kind of machine is so constructed that in a housing, a rotary shaft is supported thereto, a valve plate is fitted, a cylinder barrel having a plurality of pistons is mounted to the rotary shaft and a thrust plate is provided relatively to the pistons.

Thus, the interior of housing serves as a drain chamber for reserving therein drain which is leaked from the valve plate and others, which drain is used as a lubricant and a coolant for actuating the machine, where the drain exceeding a given amount is exhausted to a drain tank from the outlet port of drain chamber.

Namely, drain in the drain chamber is forced to flow by revolution of the cylinder barrel so as to be applied for lubrication and cooling.

However, since the flow caused by revolution of the cylinder barrel is limited to be generated around the cylinder barrel furthermore in a partial circulation thereof, drain becomes almost stationary as it is, thus no active drain renewal being generated.

Consequently, there has been such a problem that the locally increased temperature of drain reduces the cooling effect for the sliding surface of cylinder barrel or the like resulting in acceleration of contamination of drain. The concrete description of sliding surfaces is that one of them is a sliding surface between the cylinder barrel and the outer periphery of pistons, another one is a contactable interface between the back of shoes and the thrust plate, still another one is that between the cylinder barrel and the thrust plate, and still further one is a contacting surface between a spherical surface at the head of a piston and the inner surface of shoes, and otheres are at bearings of a rotary shaft and oil seal portions.

While, there is suggested one of this kind unit, of which the thrust plate is made to be slantly angularly variable by means of an operating cylinder exerted by the fluid in a high pressure line so that the discharge of fluid may be adjusted in, for example, application for the piston pump. This machine is provided in a cylinder chamber accomodating the operating cylinder with a drain path communicated with the drain chamber, thus the fluid in high pressure line being exhausted to the drain chamber through the drain path after actuating the operating cylinder.

In this instance, there is provided in the housing a drain outlet which is communicated with a drain tank, where the pressure within the drain chamber is not constant but fluctuated by a drain leakage from the valve plate and other factors.

Accordingly, when the drain in the cylinder barrel flows out therefrom to the drain chamber through the drain path, the discharge becomes variable in amount by the internal pressure of the drain chamber, therefore, an inexact discharge of drain makes the operating cylinder unstable in operation resulting in an inaccurate control of the variational characteristic of drain by means of adjustment of the slant angle of thrust plate, which is added to the abovementioned problem.

For allowing the drain to be exactly discharged, it is considered that the discharge pressure is made greater than that of drain in the drain chamber, however, since it is preferable for stabilizing the cylinder operation that the discharge pressure is made as low as possible so as to hold the drain at a given amount for actuating the cylinder, too much increased pressure of the drain, conversely, makes the variational characteristic unstable, which is not a better method for stabilizing the same.

This invention has been directed to eliminate the abovementioned defect of a conventional machine, of which a main object is the provision of an axial piston system power transmission which is adapted to allow drain in a drain chamber to be stimulated for circulation and a good renewal thereof so that the drain may exactly carry out cooling of the sliding surfaces and lubrication within the drain chamber. Another object is the provision of an axial piston system power transimission capable of making the drain discharge suitable in amount for being stabilized in pressure opposite to the thrust plate thereby making it possible to stabilize the variational characteristic of drain.

Now, this invention has been designed to form a protruded portion at one side of the inner surface of housing oppositely of the cylinder barrel for narrowing a spaced interval between the housing and cylinder barrel so that the maximum flow velocity may be generated therebetween for enforcing the drain to flow in an active circulation not only around the latter but also throughout the inside of drain chamber.

Furthermore, against the maximum flow velocity portion, that is, the minimum drain pressure portion, is opened the drain path through which drain in a high pressure line flows for exterting the operating cylinder, whereby whatever change may occure in an internal pressure of the drain chamber the drain is always properly discharged thereinto so as to stabilize the variational characteristic of drain.

Figure 2:
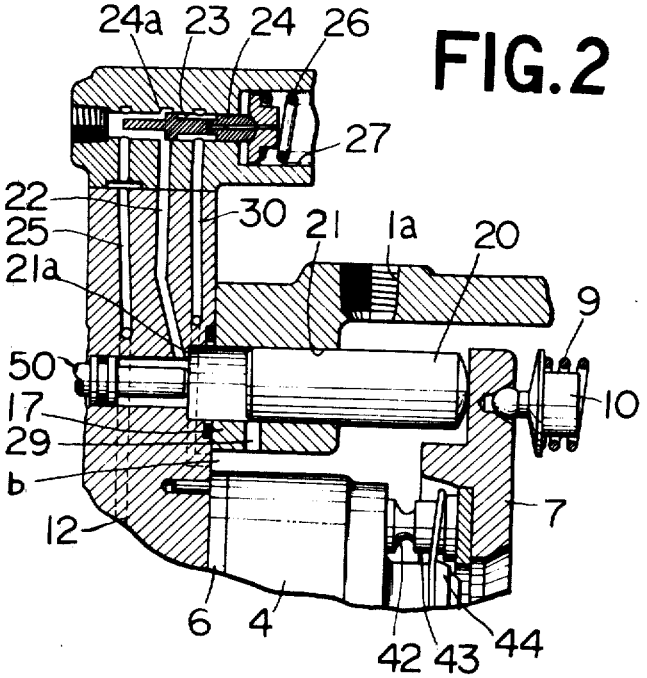
Figure 3:
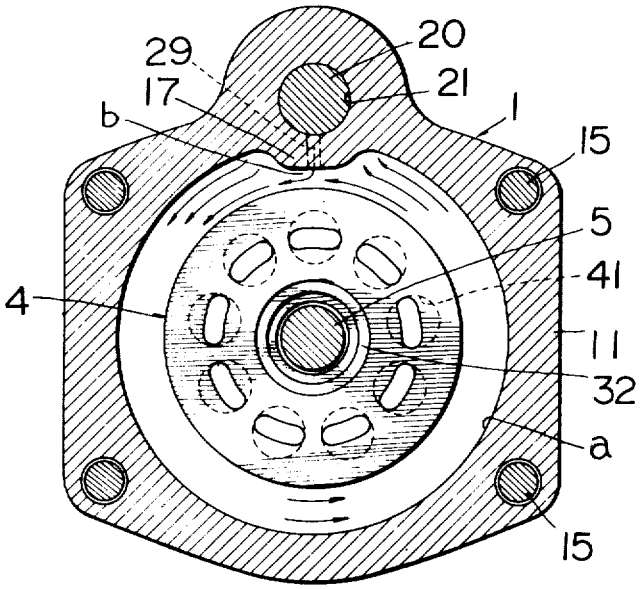
Figure 4:
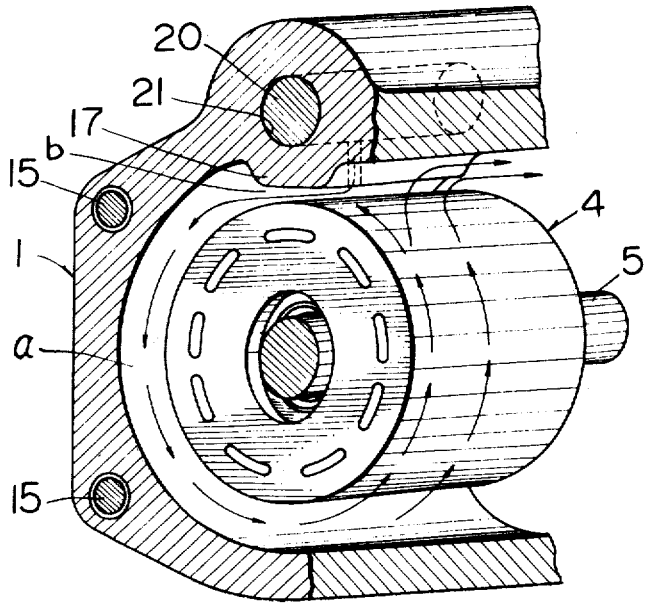
Figure 5:
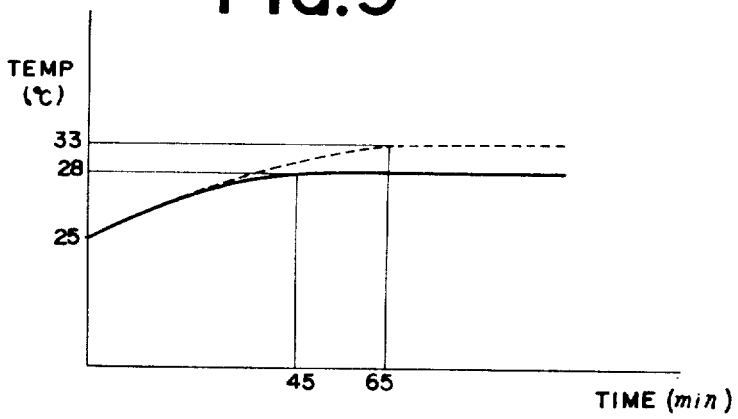
Figure 6:
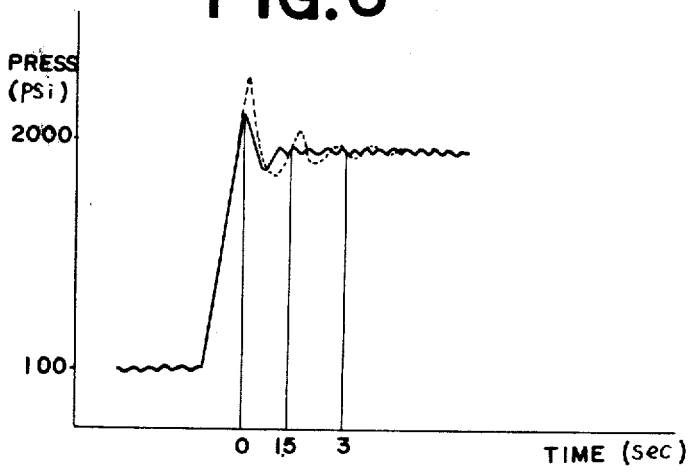

Further objects and advantages of the present invention will be apparent from the following description taken in connection with the accompanying drawings, in which:

FIG. 1 is a vertical sectional view showing a preferable embodiment of the invention, FIG. 2 is a partially sectional view showing flow of drain from a cylinder barrel into a drain chamber by operation of pistons, FIG. 3 is a sectional view taken on Line III—III in FIG. 1, FIG. 4 is a perspective view illustrating the drain flow in the drain chamber, FIG. 5 is a diagram of the temperature characteristics in the drain chamber, and FIG. 6 is that of the pressure characteristics in the drain chamber.

An embodiment shown in the drawings has been selected from axial piston pumps having a thrust plate which is variable in an angle of inclination for making the exhaust variable.

A housing 1 of the pump, comprises a main body 11 and a head 12 which are fixedly connected to each other with four mount bolts 15. Both the members are sealed with 0-shaped rings or the like so as not to cause leakage of drain from the interface thereof and the housing 1 is provided therein with a drain chamber *a* communicated to the air through a drain outlet 1*a*. The main body 11 is provided with a hole 13 perforated throughout a wall thereof, which hole is provided therein with bearing means 2, and the abovementioned head 12 is provided at the inner side thereof with a blind hole 14 into which a bearing 3 is mounted.

These two bearings 2 and 3 freely rotatably support a driving shaft 5 having a cylinder barrel 4 around a substantially end portion thereof, thus cylinder barrel 4 being adapted to be rovolved around the driving shaft by power from a motor (not shown). The cylinder barrel 4 has a plurality of axial holes 41 which accommodate an axially movable piston 42 respectively.

The cylinder barrel 4 is located between a valve plate 6 and a thrust plate 7 which are provided oppositely to each other in an axial direction of the shaft 5, and is supported thereto through a driving connection 8 of spline coupling, thereby being revolved integrally of the driving shaft 5 by rotary torque from the motor.

The valve plate 6 is unrotatably mounted closely to the inner surface of the head 12, which serves, as is well known, to communicate the holes 41 of the cylinder barrel with a suction port (not shown) and an outlet 16 which are formed in 180° phase difference with respect to each other. This valve plate 6 functions to make the drain flow from the suction port into the hole 41 of the piston in suction stroke, while, the piston in exhaust stroke forces the drain to be taken out from the piston hole to the outlet 16.

The thrust plate 7 is supported with a trunnion stud (not shown) for being freely swingingly movable in a range of a given inclination angle, and is normally urged by a spring means 9 to be slanted at the maximum angle as shown in FIG. 1. The spring means 9 is supported at one end thereof into a recess at the inner surface of the body 11 and at the end thereof with a push member 10 having at its one end a spherical head portion at one end thereof so that the push member 10 may contact at the head thereof with the thrust plate 7 for transmitting the force from the spring 9 to the thrust plate 7.

Additionally, the maximum angle of inclination of the thrust plate may be defined by a stopper 18 annularly projected from the inner surface of the body 11, which angle is also variable by means of an adjusting bolt 50 abutting against an operating plunger described hereinafter. The spring 9 is variable in its elastic force by means of an adjusting bolt 51 mounted onto the inner portion of the body 11 contactable with the spring end.

The pistons 42 have spherical heads insertibly engageable with shoes 43 respectively, which shoes 43 are contactable with the thrust plate 7 through retainers 44 having holes as many as pistons 42. Each of shoes 43 has at one end a flange 43*a* extending radially outwardly thereof and is held with the retainer in engagement of the flange with the hole of the retainer so that the flange 43*a* may be brought into contact at the lateral surface thereof with the thrust plate 7 respectively.

A protrudent portion 17, the important element of the invention, is formed so as to be protruded from the inner wall of the housing 1 toward one side of the outer periphery of the cylinder barrel 4, which is substantially equal in length to the cylinder barrel in an axial direction thereof and is substantially mountain-shaped in cross section thereof. The utmost end, i.e., the top of the chevron is close to the outer periphery of cylinder barrel 4 and the spaced interval therebetween is, as is apparent from FIG. 3, narrower than that between the outer periphery of cylinder barrel and the inner wall of the housing except the protrudent portion, thus the maximum flow velocity portion *b* is formed between the protrudent portion and the outer periphery of the cylinder barrel, where the ratio of the areas of the portion *b* and others ranges about 1 : 4 to 1 : 7 and most preferably 1 : 4.

From this, the rotation of cylinder barrel 4 causes flow of the drain stored in the drain chamber *a* inside the housing 1, which flow becomes the fastest at the maximum flow velocity portion *b*, resulting in circulation not only radially around the cylinder barrel but also, as shown in FIG. 4, at the axially lateral side thereof, and the drain at the maximum flow velocity position *b* becomes the lowest in pressure from Bernoulli's theorem, furthermore it becomes possible to form the lowest pressure portion being stabilized in pressure and less affected by the pressure fluctuation even it may occur within the drain chamber *a*. Consequently, the lubrication and cooling of sliding surfaces inside the housing 1 may be carried out by means of circulation of drain in the drain chamber *a* as aforegoing.

We have examined the temperature of drain within the housing body 11 by use of a machine of the invention and a conventional one to result in obtaining the following result as shown in FIG. 5, where the operating conditions are, the number of revolution: 1,800 r.p.m.; the pressure : 2,000 p.s.i.; the discharge amount: 0 gal and the indoor temperature : 25°C. As clearly understood from the result shown in FIG. 5, in use of the machine of the invention, the temperature rose till 28°C at 45 min but not further so that whole components were uniformly cooled, on the contrary, in conventional one the temperature rose till 33°C at 65 min as shown with a dotted line, also the temperature distribution was not uniform so that a further temperature rise at the sliding surface portion apart from the cylinder barrel caused in an extremely poor cooling effect.

In addition, the protrudent portion 17 is so formed that the wall of housing body 11 is partially swollen integrally thereof and it is preferable to form, not shown in the drawings, the portion 17 separately from the wall of the body 11 for being closely fixed to the inner surface of the body through a fixing means such as a mount bolt.

In a case that the thrust plate is, as shown in this embodiment, provided with an operating plunger 20 so as to be made variable in an angle of inclination, a cylinder hole 21 is formed at the protrudent portion 17 so that the plunger may freely movably be inserted thereinto. The cylinder hole 2 is not necessary to be formed at the protrudent portion 17 but any other portion is available, nevertheless, to form the cylinder hole at the protrudent portion becomes simple in construction and favourable in spacing. The operating plunger is brought into contact at one utmost end thereof with the thrust plate 7 at the opposite side with respect to the spring 9, whereby the plunger makes the thrust plate 7 rise toward the neutral position thereof when the control fluid flows into a back chamber 21*a* of the cylinder chamber 21. The back chamber 21*a* has an opening of a control fluid conduit 22, through which the back chamber is communicated with a spool chamber 23. There is movably inserted a spool 24 of a two-land type into the spool chamber 23 of which a primary side is connected to the discharge port 16 through a conduit 25 and the opposite side thereof is formed in a chamber 27 accomodating a coil spring 26 therein for urging the spool 24 toward the primary side thereof so that the spring 26 adjustable with an adjusting bolt 28 may define the pressure for moving the spool 24 in an axial direction thereof.

When the tensile force of spring 26 is greater than the pressure of discharged fluid, the fluid conduit 22 is closed by a first land 24*a* of the spool 24 not to be communicated with the conduit 25 at the primary side, while, when the increase of discharged fluid pressure in response to load change becomes greater than the spring 26 tensile force, the spool 24 is, as shown in FIG. 2, moved to open the conduit 22 at a given openning area so that the conduit 25 and the conduit 22 may be communicated with each other, in this instance, the fluid discharged from the conduit 25 at the primary side may be reduced in pressure to be led to the back chamber 21*a* through the conduit 22. At an intermediate portion of the cylinder chamber 21 is opened a drain path 29 for exhausting into the drain chamber *a* the fluid led to the back chamber 21*a*, which path is closed with the operating plunger 20 at inclination of the thrust plate, while, is opened when the operating plunger is moved by the high pressure of fluid introduced into the back chamber 21*a* so as to urge the thrust plate 7 closely to the neutral position thereof. This communication of the path 29 with the drain chamber *a* is carried out at the abovementioned maximum flow velocity portion *b* so that the drain may be accurately and properly exhausted into the drain pressure chamber in spite of the increase of drain therein. That is, the drain pressure becomes the lowest at the maximum flow velocity portion *b* from Bernoulli's theorem, so that the same may be reduced closely to the atmospheric pressure and maintained substantially at constant. Consequently, the drain discharge from the path 29 at the thrust plate position close to the neutral stage thereof, may be accurately carried out even though the drain pressure in the drain chamber is increased, and the path 29 can be formed in a metering-out line so as to reduce and also maintain at constant the drain discharge pressure.

Thus, the discharge amount becomes stable and the drain pressure against the thrust plate 7 is stabilized, thereby possible to obtain a better stabilized variational characteirstic.

Now, we have had the result as shown in FIG. 6 after research of a pump pressure characteristic in use of a machine of the invention and a conventional one. FIG. 6 shows characteristics of the machine of the invention and the conventional one indicated with a solid line and a dotted line respectively, where the operating condition is that the pump revolves at 1,800 r.p.m. and the pressure thereof is instantly changed from 100 to 2,000 psi.

Furthermore, the present invention is characterized in that the pressure in the drain chamber *a* which is normally changeable in a range of about 3 to 10 psi, may be restricted within a range of about 1.5 to 5 psi at the maximum flow velocity portion *b*, thereby capable of making the drain discharge less variable.

Accordingly, the surge-pressure (psi 1) of the machine in accordance with the invention becomes about two third of that (psi 2) of the conventional one and the time of stabilization ($t_1$) of the former may be designed to be about one half of that ($t_2$) of the latter.

In addition, the control fluid may be led to the spool chamber by means of a separate pump besides lead from the outlet port 16 through the conduit 25. In FIG. 1, the numeral reference 30 denotes a drain path connecting a second side of the spool chamber 23 with the drain chamber a, and the numeral referance 31 denotes a coil spring which is insertibly mounted into a center hole of the cylinder barrel for urging the cylinder barrel to the valve plate 6, and is engaged at one end thereof with a ring 32 and at the other end with a flange 5*a* at the driving shaft 5 through another ring.

An embodiment of the invention, which is constructed as aforegoing, will be described of the function thereof in the following. FIG. 1 is showing the state that the thrust plate 7 inclines at the maximum angle for making the maximum fluid discharge from pistons 42.

In this state, the rotation of main shaft 5 forces the fluid into the primary side of spool 24 from the discharge port 16 through the conduit 25, in this instance, the spool is stationary when the fluid pressure is under the predetermined value settled by tensile force of spring 26, resulting in a continued operation of the cylinder barrel under the condition of the maximum fluid discharge.

Now, under this condition the load such as an actuator or the like is increased to raise the fluid pressure more than the pressure settled to the spool by the spring 26, then the spool 24 is moved against the tensile force of spring 26 to open the conduit 22 at a given opening area for relieving the fluid to result in the pressure generation in the conduit 22 and the back chamber 21*a* whereby the plunger 20 is operated to force the thrust plate 7 toward the neutral position thereof for automatically reducing the fluid discharge. Conversely, upon absence of loads the fluid pressure becomes under the predetermined value the spool 24 returns by the spring effect, and the fluid led into the back chamber 21*a* is exhausted into the housing 1 through the conduit 22, the spool chamber 23 and the drain path 30, whereby the thrust plate 7 is restored to the maximum inclined position thereof by means of the tensile force of spring 9 and the moment of rotation of the cylinder barrel 4.

Upon continuation of loads, the operating plunger 20 is kept on moving for making the thrust plate 7 reach the neutral position thereof. Just before this reach the drain path 29 is opened to allow the fluid full in the back chamber 21*a* to be properly flown therefrom into the maximum flow velocity portion *b* through the drain path 29, thus the continuation of intake and outflow of drain from the back chamber 21*a* to the portion *b* retaining the thrust plate 7 in a stable condition.

Since the fluid is, as aforegoing, exhausted to the maximum flow velocity portion *b* through the drain path 29 after reliefed in the back chamber 21*a*, a proper amount thereof may be exhausted into the drain chamber *a* even if the internal pressure thereof increases more than the atomospheric pressure, thereby capable of stabilizing the reduced pressure and obtaining the stabilized variational characteristic of this system.

In the abovementioned function, the revolution of cylinder barrel 4 caused the drain in the drain chamber to flow arround the same, however, merely a partial drain is, as shown in FIG. 4 passable through the maximum flow velocity portion *b* and the drain mostly flows before the portion *b* towards the right-hand side of cylinder barrel 4 as shown in FIG. 1, namely, flows into the thrust plate side of the drain chamber *a*, thus the drain led into the right-hand side portion of the same flows to be mixed with drain remained therein and flows again toward the maximum flow velocity portion *b* from the right hand side of cylinder barrel 4 so as to circulate around the latter and also inside the drain chamber. In this condition, when the drain path 29 is opened by approach of the thrust plate to the neutral position thereof, the drain is discharged into the portion *b* through the path 29 to be added to the above-mentioned circular flow around the cylinder barrel. The flow of mixed drain mostly turns before the maximum so velocity portion *b* toward the axially lateral side of cylinder barrel and then proceeds once more to the portion *b* from the rear of the thrust plate.

Thus the revolution of cylinder barrel forces drain in the drain chamber to flow not only around the cylinder barrel but also from the axially lateral side thereof toward the thrust plate so that the drain may be circulated in the drain chamber without a partial flow and most stay thereof.

Furthermore, when the drain path 29 is opened a new drain flows therethrough into the drain chamber to be circulated therein, thereby to carry out a drain renewal.

Incidentally, upon remaining of drain more than required in the drain chamber, the surplus thereof is of course fed back to a tank from a tank line through the outlet port 1*a*.

As clearly understood from the description, heretofore, the invention is so directed that the drain flow caused by the revolution of cylinder barrel is forced to circulate at the thrust plate side as well as around the cylinder barrel in the drain chamber so that whole drain therein may always alternately flow to be kept in its fluidity. Accordingly, the drain fluid is prevented from any significant temperature rise, thereby making it possible to actively cool sliding surfaces of the cylinder barrel and others.

Also, a system employing an angularly variable thrust plate has the drain exhausted from the back chamber of the operating plunger into the maximum flow velocity portion by means of the opened drain path, whereby a proper discharge of drain may always be carried out even increase of the pressure in the drain chamber, furthermore, it is possible to discharge the drain through the drain path at the reduced pressure nearly the same as the atomospheric pressure and also to keep the discharge pressure constant so that the angularly inclined position of the thrust plate caused by the operating plunger, i.e., the fluid pressure, may be stable for obtaining the stabilized variational characteristic of the system.

The construction concretely descried heretofore employs the angularly variable thrust plate which is adjustable by the operating plunger. Besides, the same is the construction employing a fixed thrust plate, which is not shown in the drawings but may easily be understandable from that in FIG. 1.

While an embodiment of the invention has been shown and described, the invention is not limited to the specific construction thereof, which is merely exemplified in the specification rather than is defined.

What is claimed is:

1. An axial piston power transmission comprising:

a. a housing having a stationary valve plate, b. a rotary shaft supported internally in said housing and extending transversely thereof through said housing, c. said housing having a drain outlet spaced vertically above said rotary shaft, d. a cylinder barrel supported with said rotary shaft to be rotatable relative to said valve plate, said cylinder barrel having a plurality of holes extending in an axial direction thereof, e. a plurality of pistons mounted for reciprocation within said holes respectively, f. a thrust plate mounted inside said housing and connected to each said piston, said thrust plate being adjustable so as to be disposable at an angle relative to the axis of said rotary shaft, g. an adjusting means for said thrust plate including spring means disposed on one side of said thrust plate for urging said thrust plate toward a maximum angle of inclination relative to said rotary shaft, plunger means mounted in a cylinder disposed in a chamber on the other side of said thrust plate for moving said thrust plate against the force of said spring means, a conduit for delivering a control fluid to said chamber to move said plunger and, thereby, said thrust plate, control means for regulating fluid flow through said conduit, said chamber being disposed to extend axially relative to said housing and protruding radially inwardly toward said cylinder barrel, said cylinder chamber having an exterior axial length substantially equal to that of said cylinder barrel so that the space between said cylinder barrel and said exterior of said cylinder chamber defines a restricted flow path for fluid in said housing whereby, when said cylinder barrel is rotating, fluid flowing through said restricted flow path will attain a maximum velocity flow, h. said cylinder chamber having an outlet passage opening to said restricted flow path between said cylinder chamber and said cylinder barrel so that fluid from said outlet passage will be forceably circulated around said cylinder barrel and thereafter discharged externally of said housing through said drain outlet in said housing.

2. An axial system power transmission as claimed in claim 1, wherein said housing has an interior surface that is spaced from the exterior surface of said cylinder barrel and the ratio of the space between the exterior of said cylinder barrel and the exterior of said cylinder chamber and the space between said cylinder barrel and said interior surface of said housing is between the range of 1:4 to 1:7.

3. The axial piston system power transmission as claimed in claim 1 wherein said cylinder chamber is formed as a separate member from the housing and is closely fixed to the interior surface of said housing.

* * * * *